US010431189B2

(12) United States Patent
Green et al.

(10) Patent No.: US 10,431,189 B2
(45) Date of Patent: Oct. 1, 2019

(54) DAMPENING DEVICE FOR AN INSTRUMENTAL DRUM

(71) Applicant: Roger Green, San Clemente, CA (US)

(72) Inventors: Roger Green, San Clemente, CA (US); Andrew Namminga, Newport Beach, CA (US); Rian Abraham, Newport Beach, CA (US)

(73) Assignee: Roger Green, San Clemente, CA (US)

( * ) Notice: Subject to any disclaimer, the term of this patent is extended or adjusted under 35 U.S.C. 154(b) by 0 days.

(21) Appl. No.: 16/221,209

(22) Filed: Dec. 14, 2018

(65) Prior Publication Data

US 2019/0189093 A1 Jun. 20, 2019

Related U.S. Application Data

(60) Provisional application No. 62/607,571, filed on Dec. 19, 2017.

(51) Int. Cl.
*G10D 13/00* (2006.01)
*G10D 13/02* (2006.01)

(52) U.S. Cl.
CPC ..... *G10D 13/022* (2013.01); *G10D 13/025* (2013.01)

(58) Field of Classification Search
CPC ..... G10D 13/022; G10D 13/025
See application file for complete search history.

(56) References Cited

U.S. PATENT DOCUMENTS

| | | | | |
|---|---|---|---|---|
| 4,246,825 | A | 1/1981 | Hodas | |
| 5,606,142 | A | 2/1997 | Volpp | |
| 7,728,211 | B1 | 6/2010 | Gatzen | |
| 10,233,052 | B2 * | 3/2019 | Joyner | A45C 13/30 |

* cited by examiner

*Primary Examiner* — Kimberly R Lockett
(74) *Attorney, Agent, or Firm* — Stetina Brunda Garred and Brucker; Mark B. Garred

(57) ABSTRACT

A drum dampening device includes a foam pad adapted to be selectively engageable with drum wires on the drum. The foam pad is configured to dampen vibrations of the drum wires when the foam pad is engaged with the drum wires. A support plate is coupled to the foam pad, and a base plate is coupled to the support plate. An adjustment lever is coupled to the support plate and the base plate. The adjustment lever is selectively transitional between a first position and a second position, with transition of the adjustment lever from the first position toward the second position causing at least a portion of the support plate to move away from the base plate resulting in engagement of the foam pad with the drum wires.

20 Claims, 18 Drawing Sheets

DAMPENING DEVICE FOR AN INSTRUMENTAL DRUM

CROSS-REFERENCE TO RELATED APPLICATIONS

This application claims the benefit of U.S. Provisional Application No. 62/607,571, filed Dec. 19, 2017, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a percussion accessory, and more specifically, to a device for dampening unwanted vibrations of wires on a snare drum.

2. Description of the Related Art

A conventional snare drum is a percussion instrument that is typically used to generate a sharp staccato sound when a head of the snare drum is struck with a drum stick or other implements. Typical construction of a snare drum includes an upper head, a bottom head and a sidewall extending between the upper head and bottom head. A series of metal wires extend along the surface of the bottom head and vibrate against the bottom head when the upper head is struck with the drum stick to generate the characteristic rattle sound of the snare drum.

A problem with conventional snare drums is that the metal wires not only vibrate when the upper head is struck, but the wires may also vibrate when other activities occur in close proximity to the snare drum. For instance, when guitars, keyboards or other instruments are played near the snare drum, the wires on the snare drum may vibrate. Indeed, almost any ambient sound may lead to unwanted vibrations of the wires. The scientific term for such ambient-noise induced vibrations is "sympathetic vibrations," although those in the music community commonly refer to this phenomenon as "snare buzz." It is difficult to avoid snare buzz due to the wires being in a hard to reach location, i.e., extending under the drum.

Accordingly, there is a need in the art for a dampening device which mitigates unwanted vibrations of snare drum wires. Various aspects of the present disclosure address this particular need, as will be discussed in more detail below.

BRIEF SUMMARY

In accordance with one embodiment of the present disclosure, there is provided a dampening device adapted for use with a drum having drum wires. The dampening device may be selectively actuated between a dampening position, wherein the dampening device is engaged with the drum wires to mitigate unwanted vibration thereof, and a disengaged position, wherein the dampening device is disengaged from the drum wires to allow the drum wires to freely vibrate.

According to one embodiment, the dampening device includes a foam pad adapted to be selectively engageable with the drum wires, with the foam pad being configured to dampen vibrations of the drum wires when the foam pad is engaged with the drum wires. A support plate is coupled to the foam pad, and a base plate is coupled to the support plate. An adjustment lever is coupled to the support plate and the base plate. The adjustment lever is selectively transitional between a first position and a second position, with transition of the adjustment lever from the first position toward the second position causing at least a portion of the support plate to move away from the base plate resulting in engagement of the foam pad with the drum wires.

According to another embodiment, the dampening device includes a base having at least one tracking groove formed therein. At least one tracking pin is operatively engaged with the at least one tracking groove. A rotating plate is coupled to the at least one tracking pin and is rotatable relative to the base between a first rotational position and a second rotational position. A dampening pad is coupled to the rotating plate. Interaction between the at least one tracking pin and the at least one tracking groove causes at least a portion of the rotating plate to move away from the base in response to rotation of the rotating plate from the first rotational position to the second rotational position. Interaction between the at least one tracking pin and the at least one tracking groove causes at least a portion of the rotating plate to move toward the base in response to rotation of the rotating plate from the second rotational position to the first rotational position.

The base may be disposed about a central axis, and the base may include an upper edge, a lower edge, an inner surface and an outer surface. Both the inner and outer surfaces may extend about the central axis between the upper and lower edges. The base may include a plurality of recesses extending from the lower edge, with each recess being sized to be engageable with a drum stand. The plurality of recesses may include three recesses spaced 120 degrees from each other.

The at least one tracking groove may include at least two sloped segments and a rest segment, wherein each sloped segment includes an axial component parallel to the central axis, and a radial component. The at least one tracking groove may include at least three sloped segments and three rest segments. The at least one tracking groove may include three tracking grooves. The at least one tracking groove may extend completely between the inner surface and the outer surface of the base.

The base may define a distance between the upper and lower edge that is substantially uniform around the circumference of the base. In an alternative embodiment, the upper edge may include a ramp segment, wherein the distance between the upper edge and the lower edge varies.

The dampening device may include a handle coupled to and extending from the rotating plate.

The dampening pad may be detachably coupled to the rotating plate.

According to another implementation, the dampening device includes a base extending around a central axis and positionable adjacent the drum wires on the drum. A rotating plate is operatively coupled to base and is rotatable relative to the base about the central axis between a first rotational position and a second rotational position. Interaction between the rotating plate and the base may cause at least a portion of the rotating plate to move away from the base in response to rotation of the rotating plate from the first rotational position to the second rotational position. Interaction between the rotating plate and the base may cause at least a portion of the rotating plate to move toward the base in response to rotation of the rotating plate from the second rotational position to the first rotational position. A dampening pad is coupled to the rotating plate and is engageable with the drum wires on the drum to mitigate vibration of the drum wires, such that when the base is positioned adjacent the drum wires, movement of the rotation body from the first rotational position toward the second rotational position moves the dampening pad toward the drum wires, and movement of the rotation body from the second rotational position toward the first rotational position moves the dampening pad away from the drum wires.

The base may include at least one guide surface having an axial component and a radial component relative to the central axis. The at least one guide surface may include three axial components and three radial components.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a dampening device for a snare drum and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Various aspects of the present disclosure are directed toward an accessory for use with a snare drum to markedly reduce or eliminate unwanted vibrations of drum wires. Such unwanted vibrations are scientifically referred to as "sympathetic vibrations," but are commonly referred to in the music community as "snare buzz," and thus, the accessory is adapted to dampen snare buzz.

Figure 1:
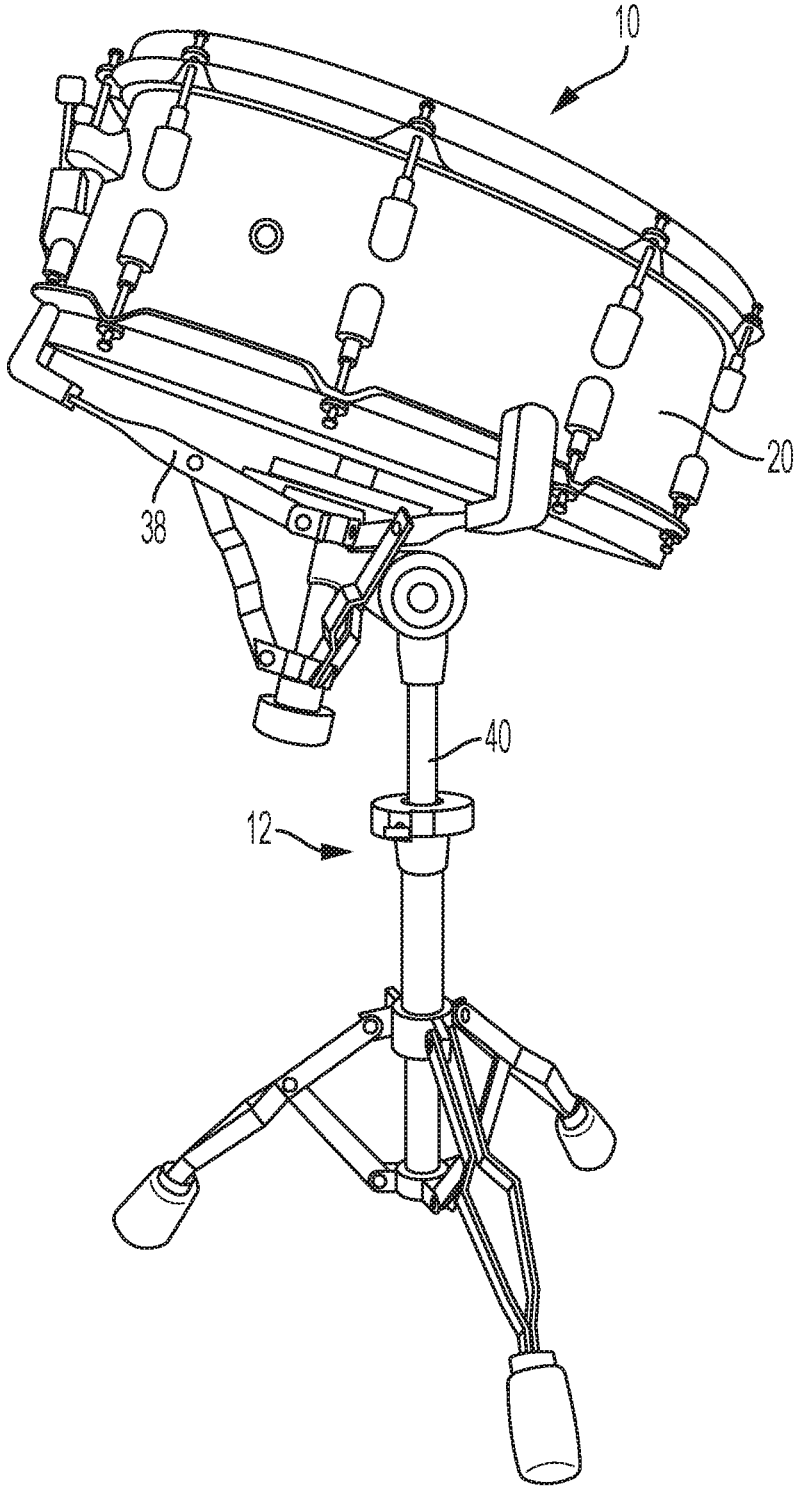
FIG. 1 is a side view of a snare drum resting on a support stand.
Figure 2:
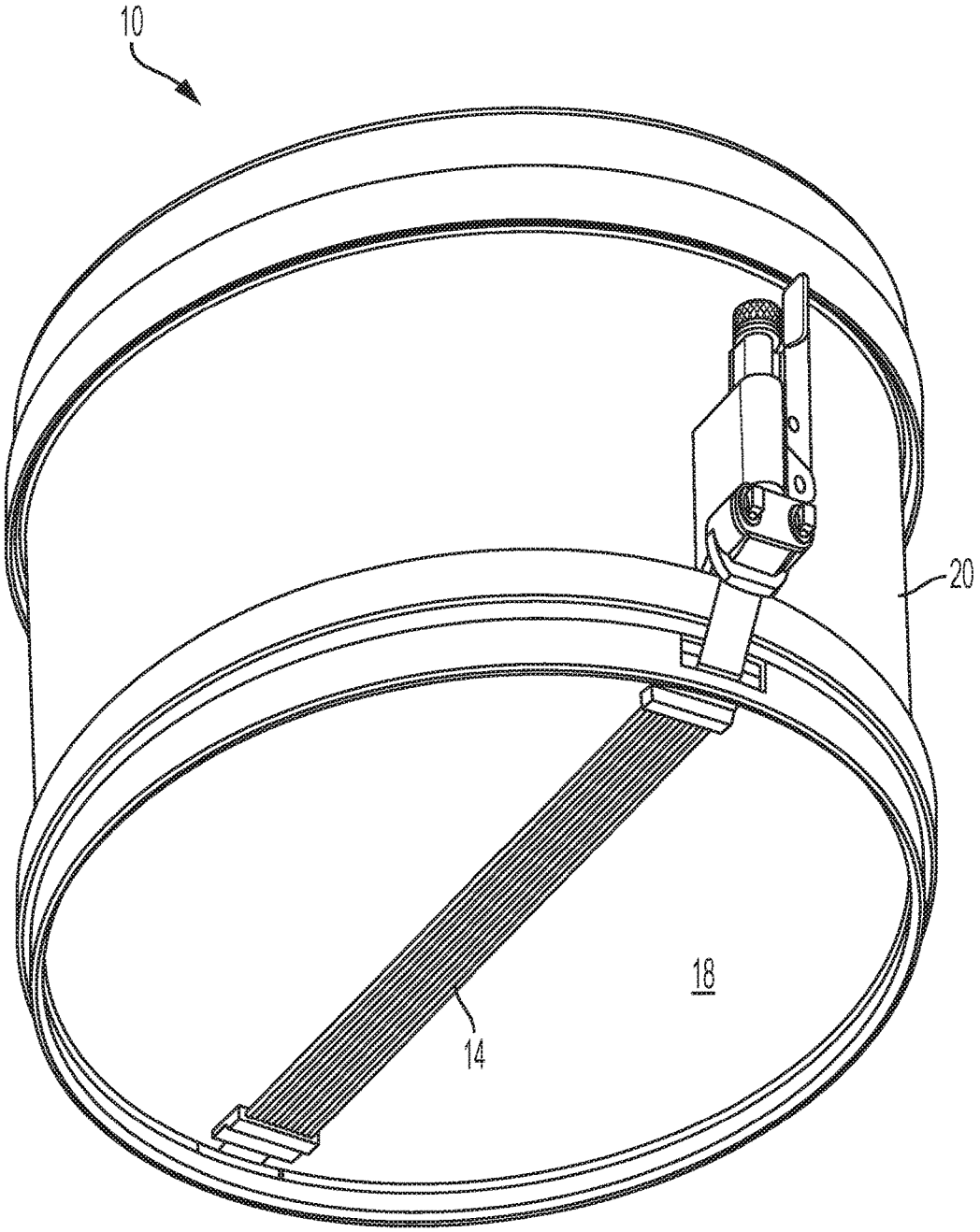
FIG. 2 is a lower perspective view of an exemplary snare drum having drum wires extending along a bottom head thereof.

Referring now to the drawings, FIG. 1 shows an exemplary snare drum 10 supported on a stand 12, and FIG. 2 depicts a lower perspective view of snare drum 10 to illustrate exemplary drum wires 14 commonly found on snare drums 10. In general, the snare drum 10 includes an upper drum surface, an opposing lower drum surface 18, and a sidewall 20 extending between the upper drum surface and the lower drum surface 18. The drum wires 14 are mounted to the sidewall 20 and extend diametrically over the lower drum surface 18. The snare drum 10 is configured such that a user strikes the upper drum surface with a drum stick, which causes the drum wires 14 to vibrate against the lower drum surface 18 to give the snare drum 10 its characteristic sound.

According to one embodiment, and referring now to FIGS. 3-17, there is depicted a dampening device 22 configured to be attachable to the snare drum 10 and adapted to selectively engage with the drum wires 14 to mitigate unwanted vibrations of the drum wires 14. In this regard, the dampening device 22 is designed to reduce unwanted snare buzz. The general structure of the dampening device 22 includes a lower portion attachable to the drum stand 12, and an upper portion rotatable relative to the lower portion to raise and lower a dampening pad 24 relative to the snare drum 10. In this regard, by selectively rotating the upper portion relative to the lower portion, the dampening device 22 selectively engages and disengages with the snare drum 10 to achieve a desired dampening effect.

Figure 3:
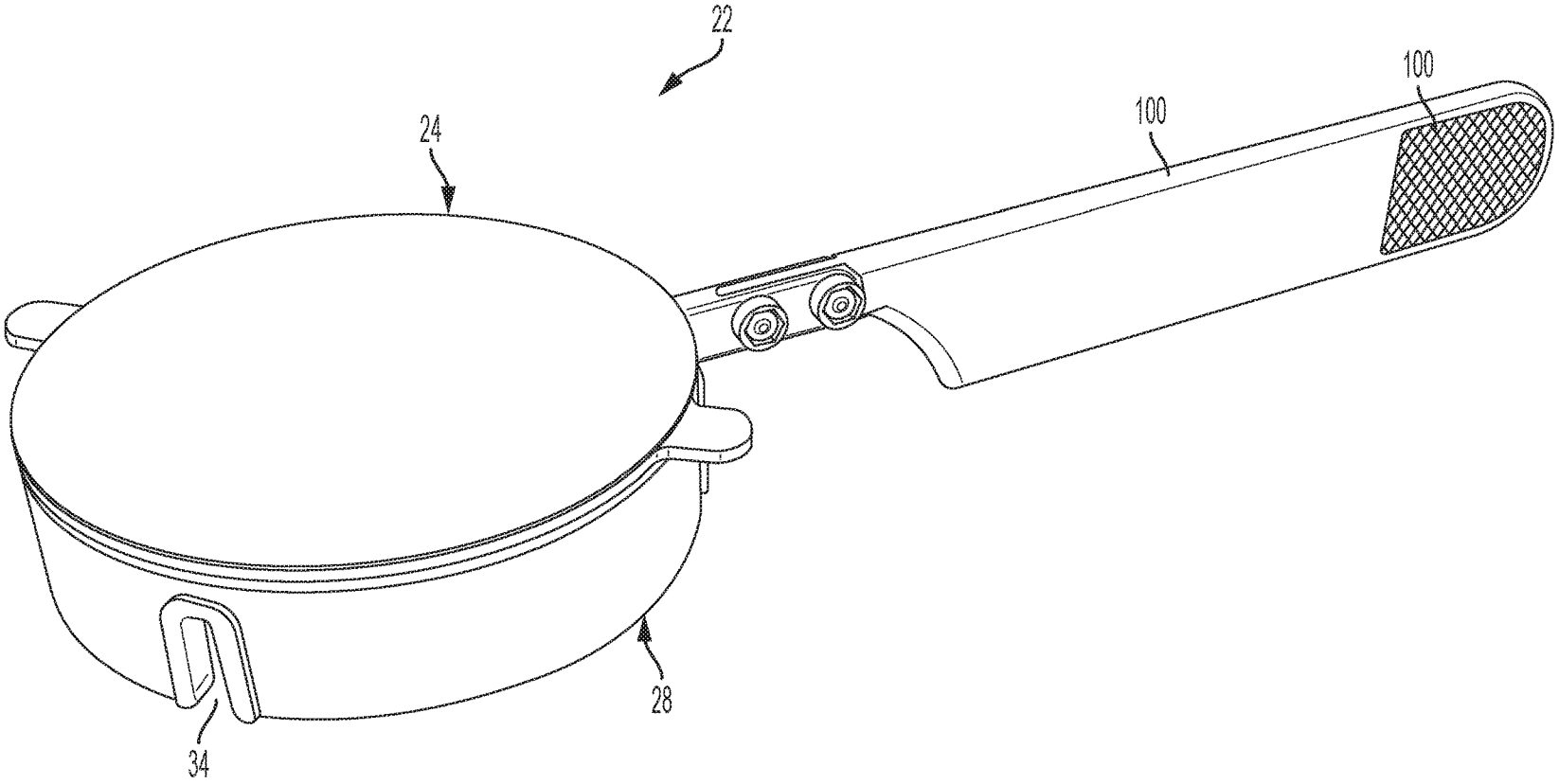
FIG. 3 is an upper perspective view of a dampening device in accordance with an embodiment of the present disclosure.
Figure 4:
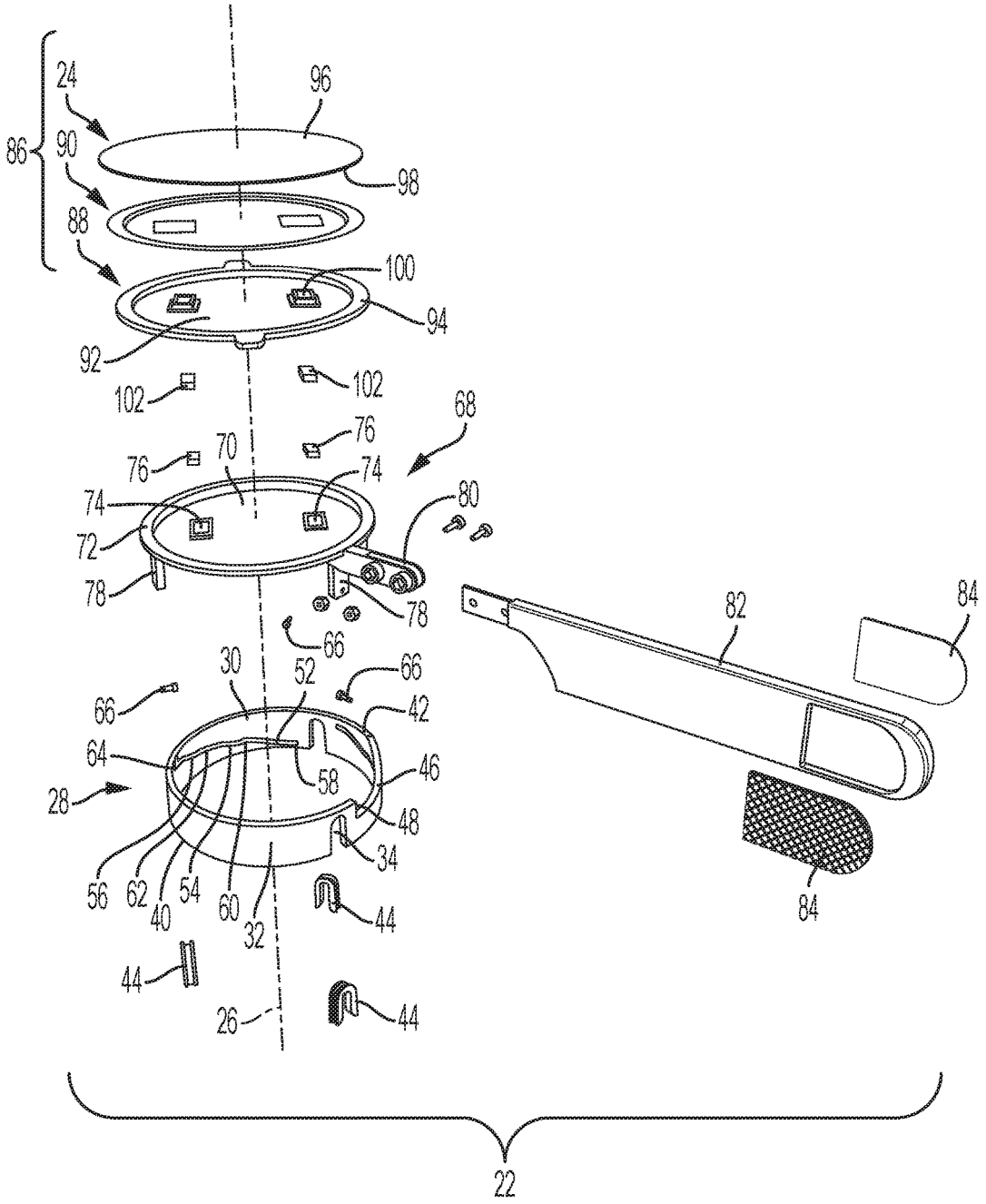
FIG. 4 is an exploded upper perspective view of the dampening device.
Figure 5:
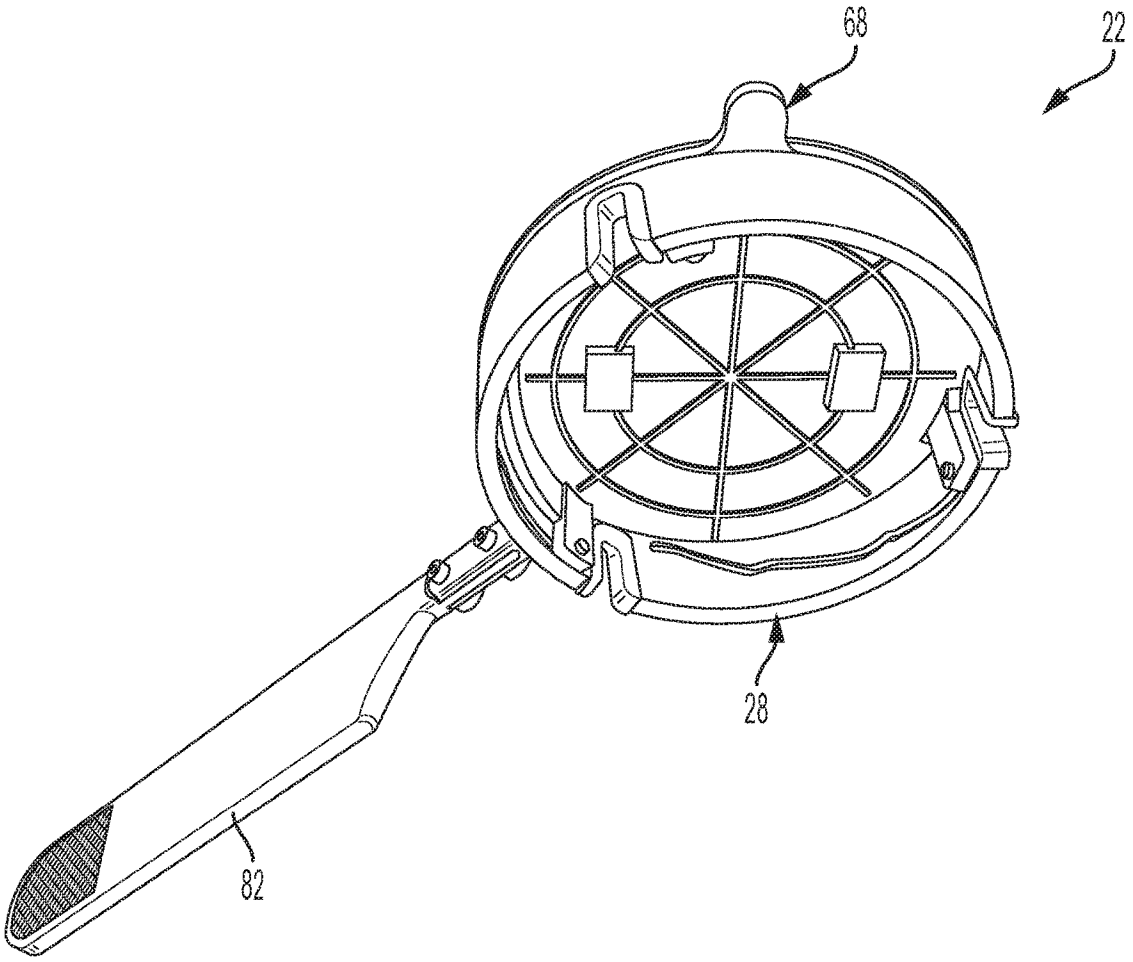
FIG. 5 is a lower perspective view of the dampening device.
Figure 6:
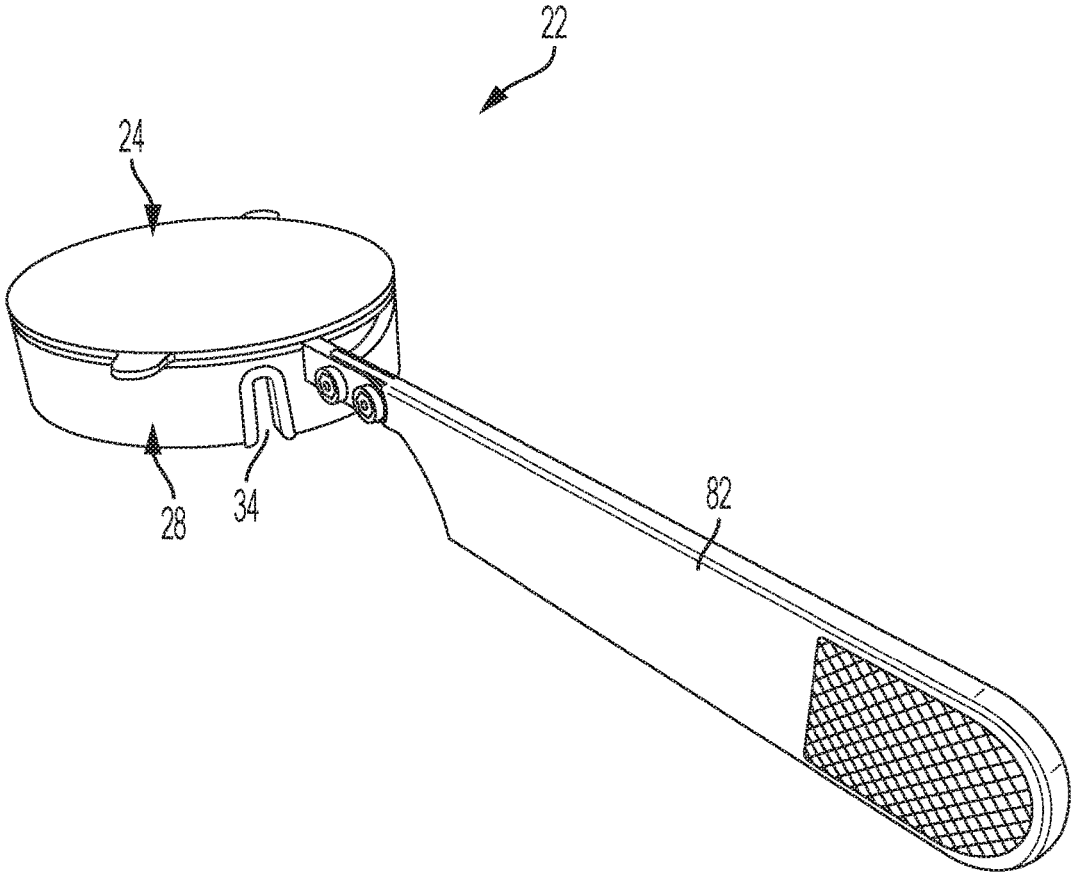
FIG. 6 is an upper perspective view of the dampening device taken from a first side.
Figure 7:
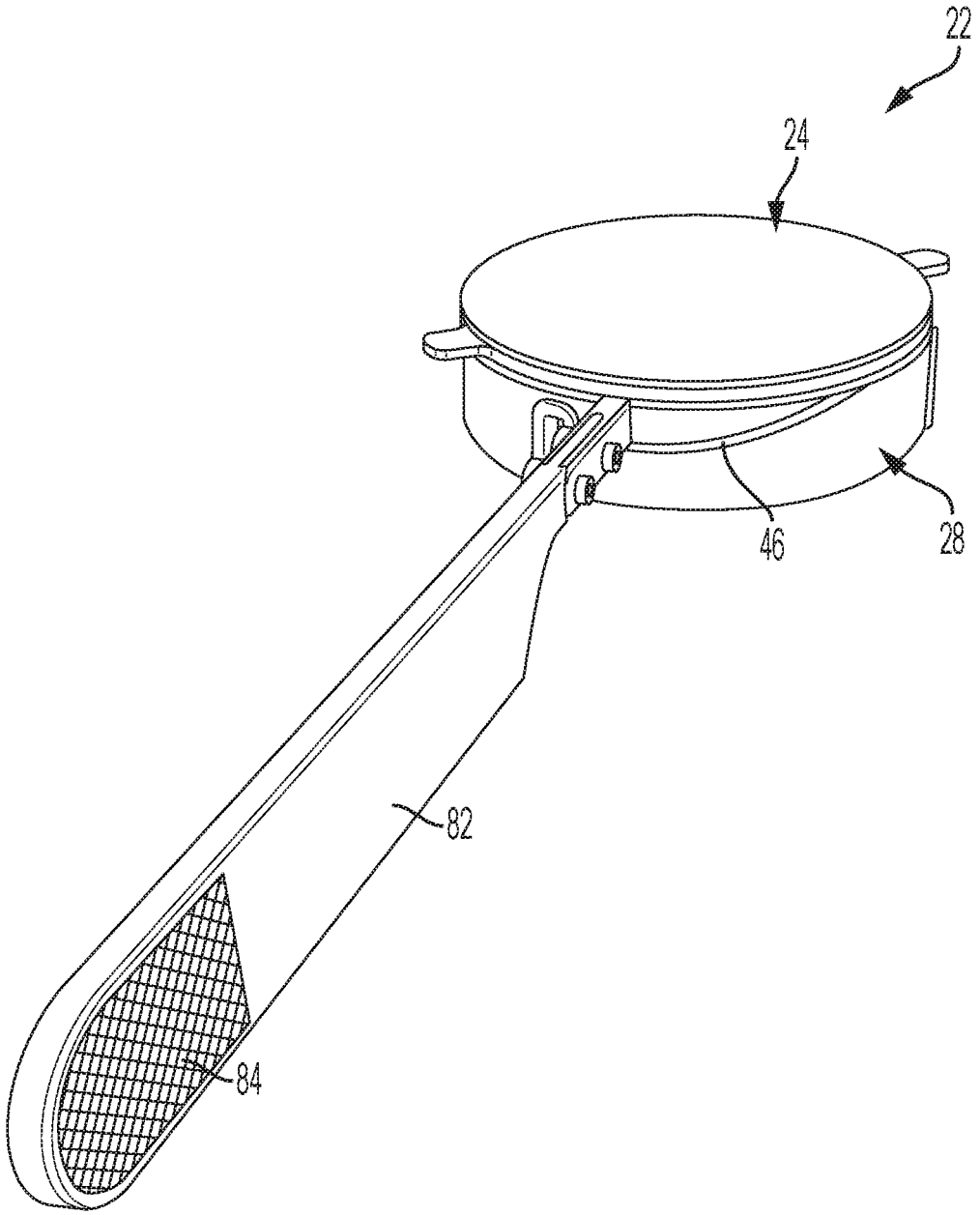
FIG. 7 is an upper perspective view of the dampening device taken from a second side.
Figure 8:
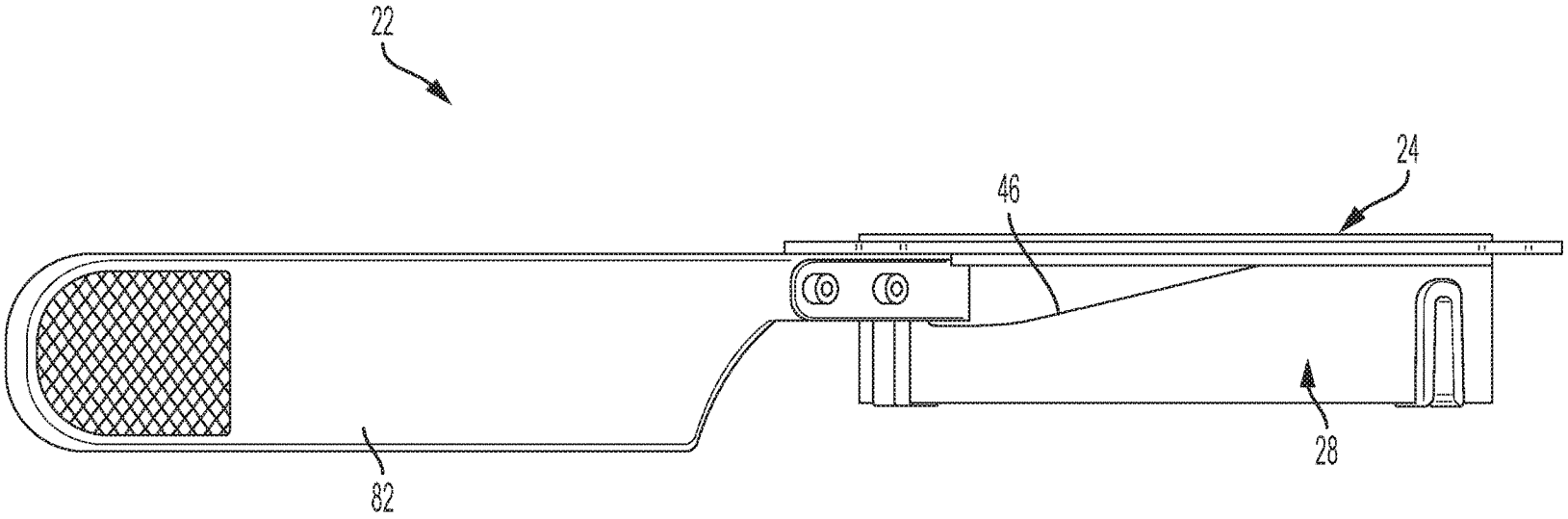
FIGS. 8-9 are side views of the dampening device taken from different sides of the dampening device.
Figure 9:
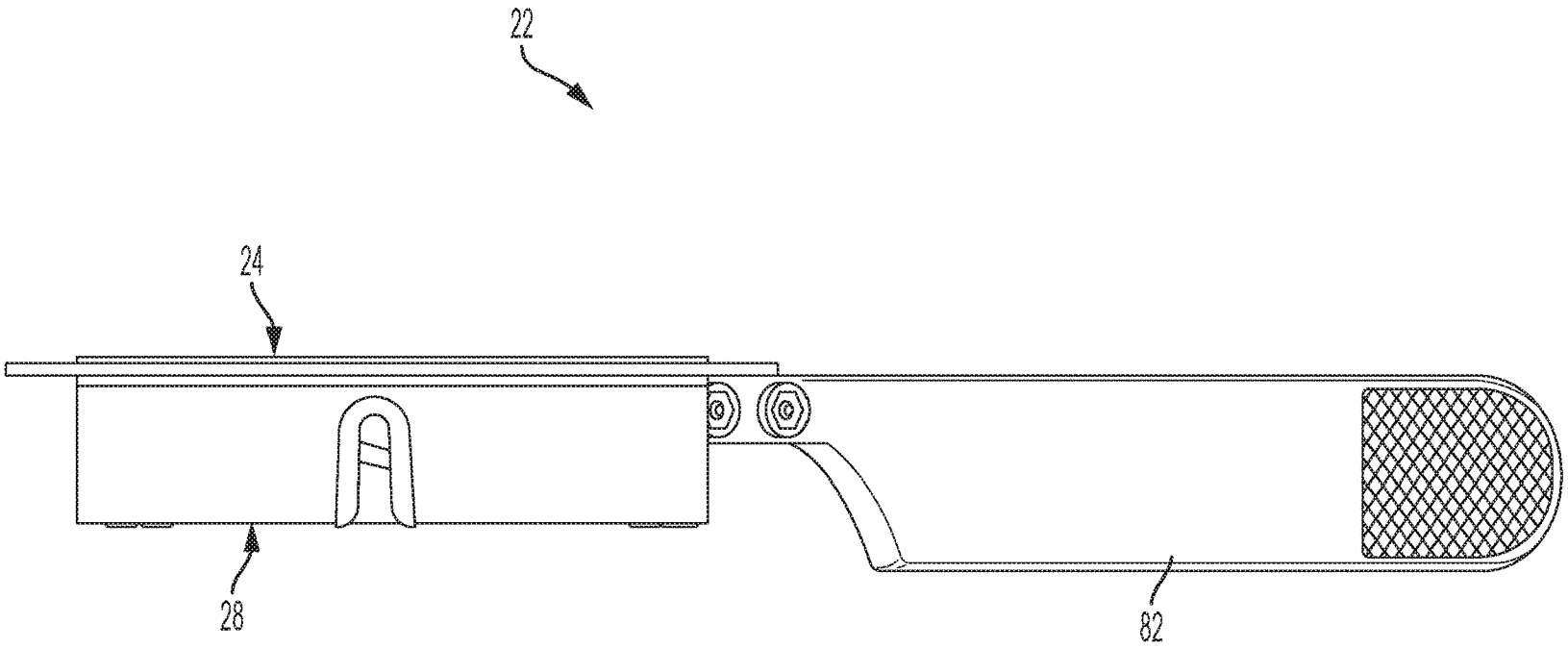
Figure 10:
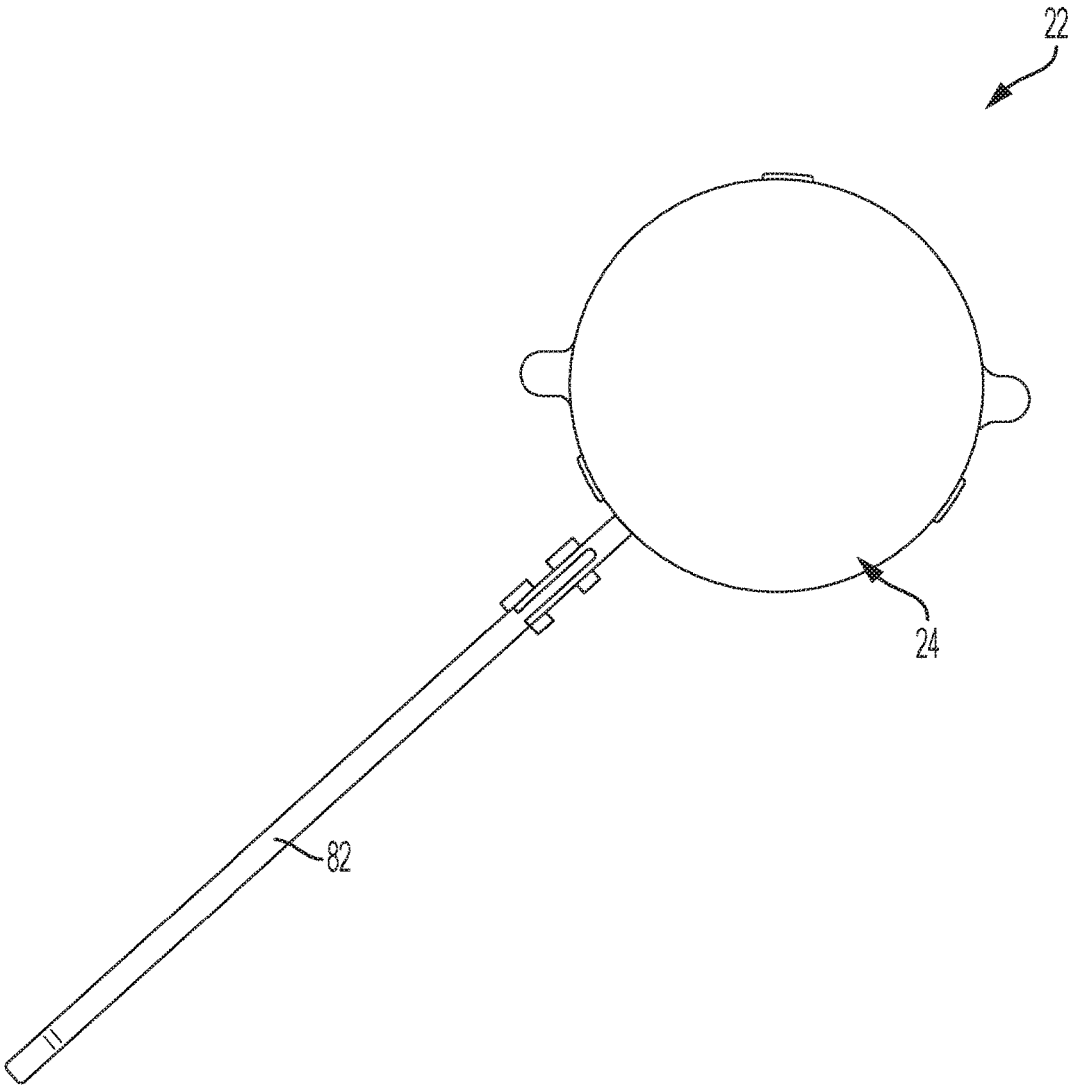
FIG. 10 is a top view of the dampening device.
Figure 11:
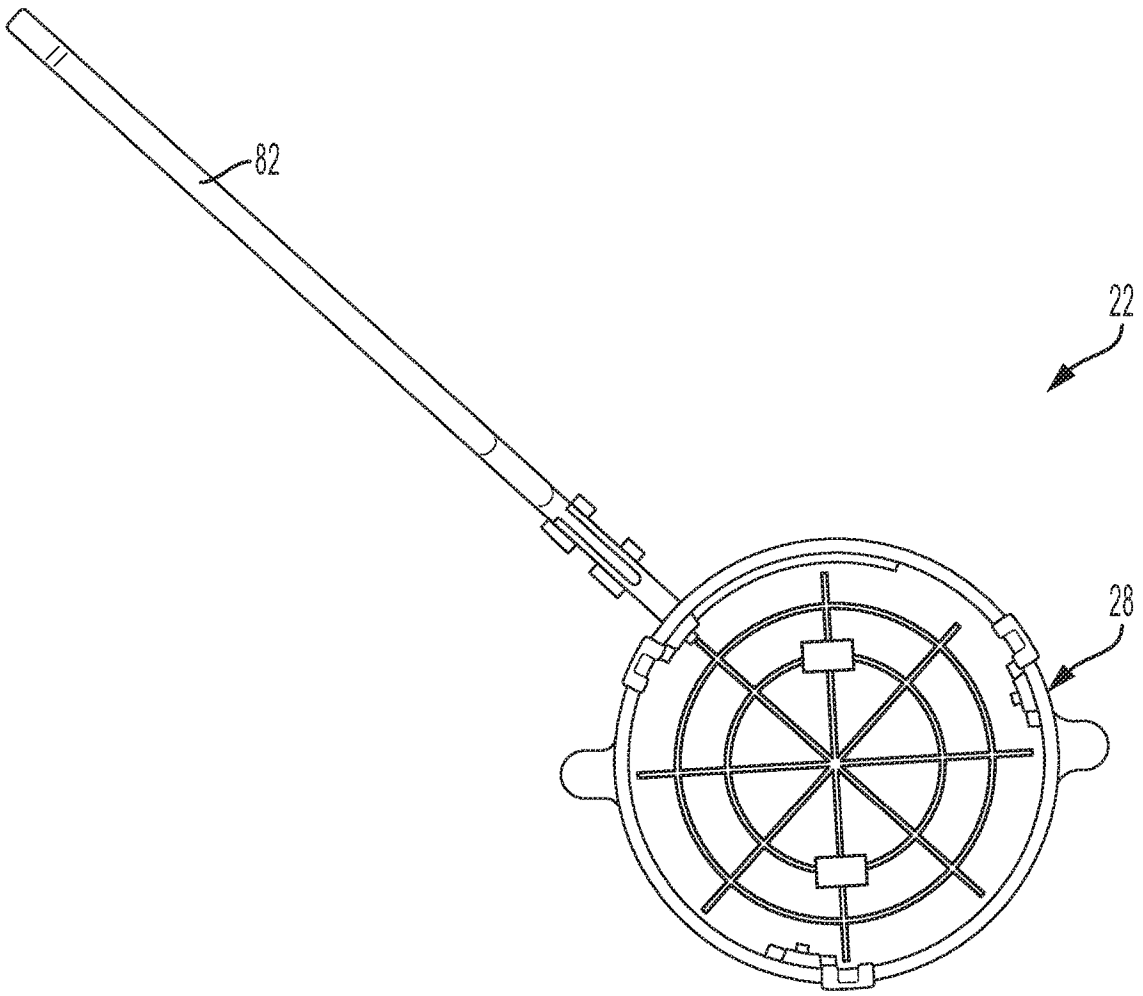
FIG. 11 is a bottom view of the dampening device.
Figure 12:
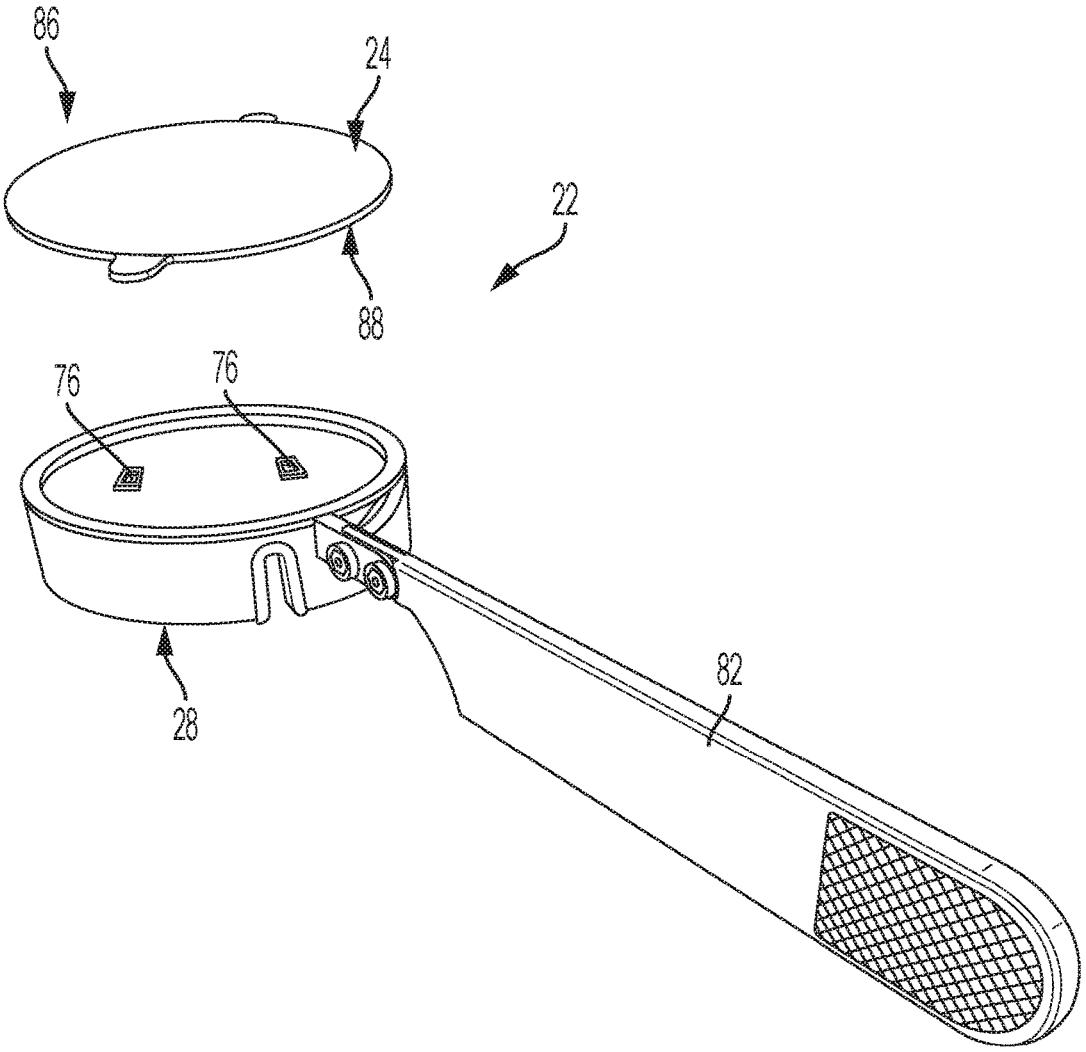
FIG. 12 is a partially exploded upper perspective view of the dampening device.
Figure 13:
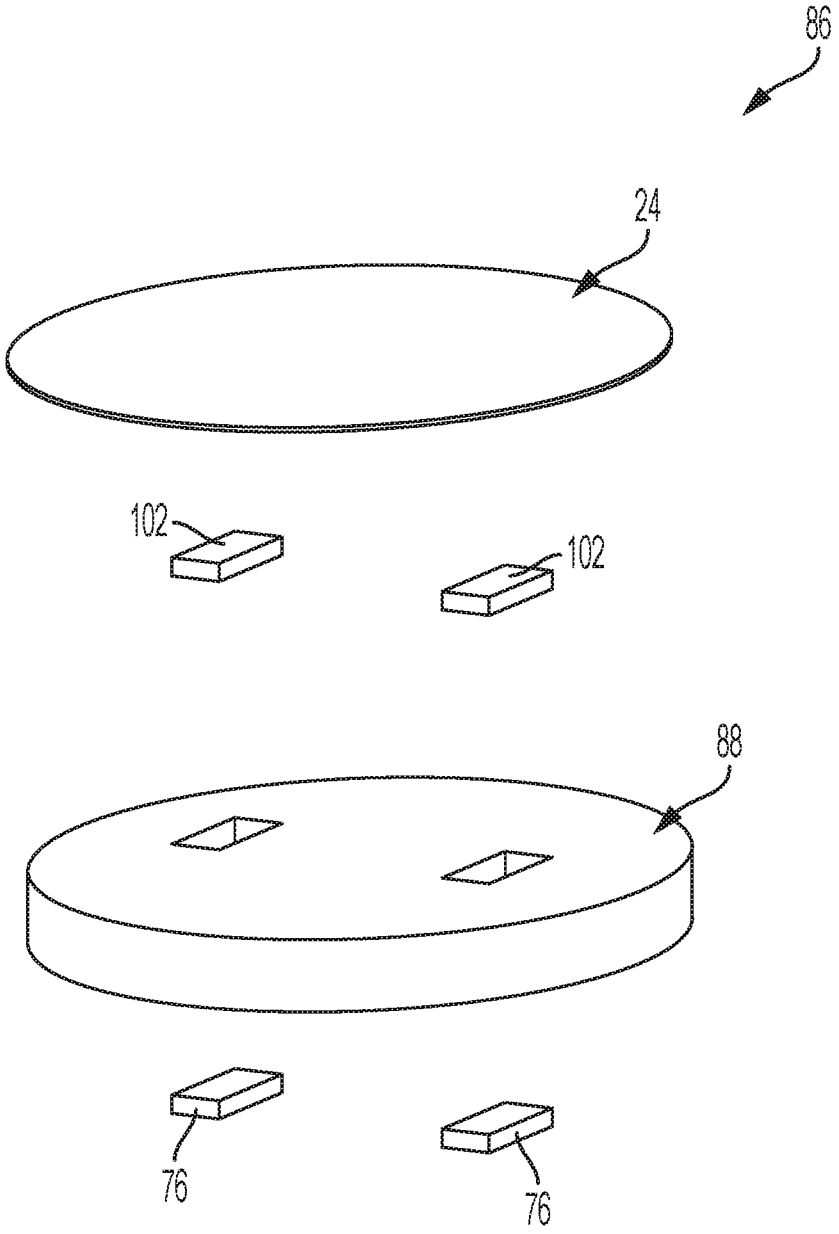
FIG. 13 is an exploded upper perspective view of an upper assembly of the dampening device.
Figure 14:
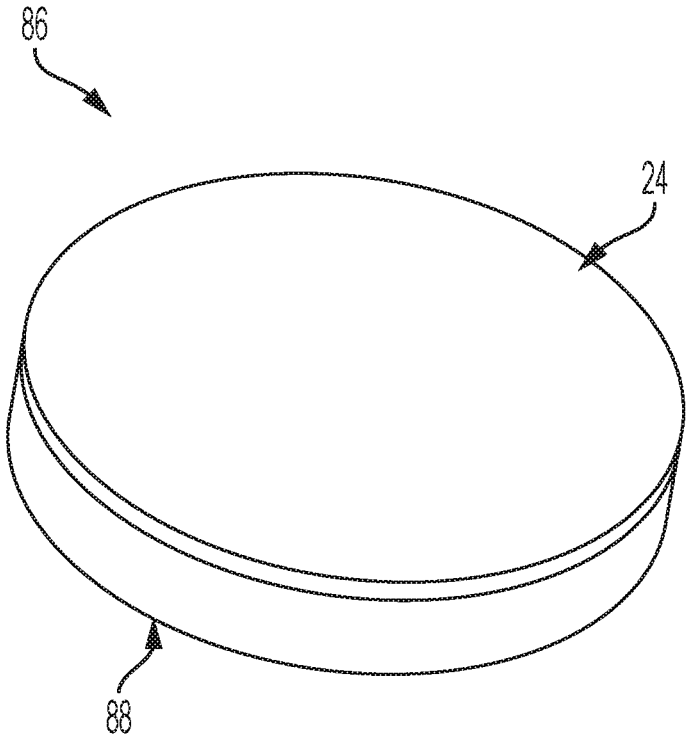
FIG. 14 is an upper perspective view of a dampening pad used in the upper assembly.
Figure 15:
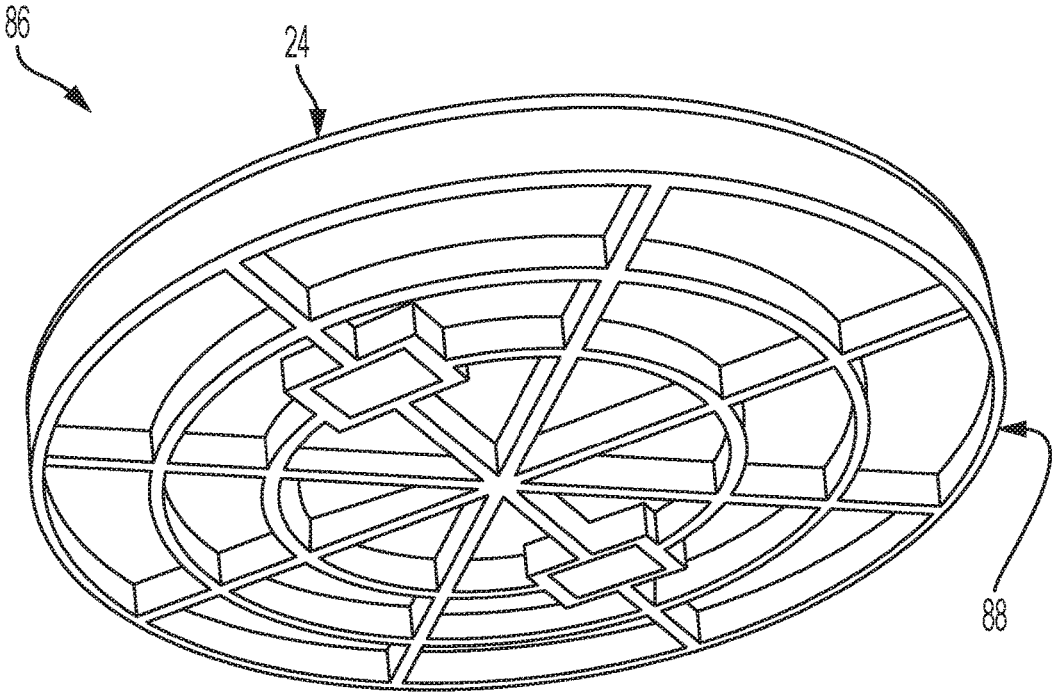
FIG. 15 is a lower perspective view of the upper assembly.
Figure 16:
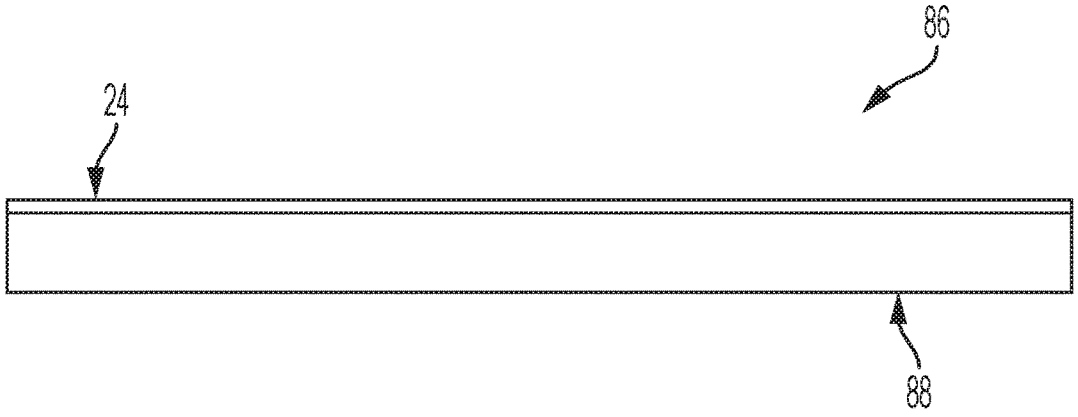
FIG. 16 is a side view of the upper assembly.
Figure 17:
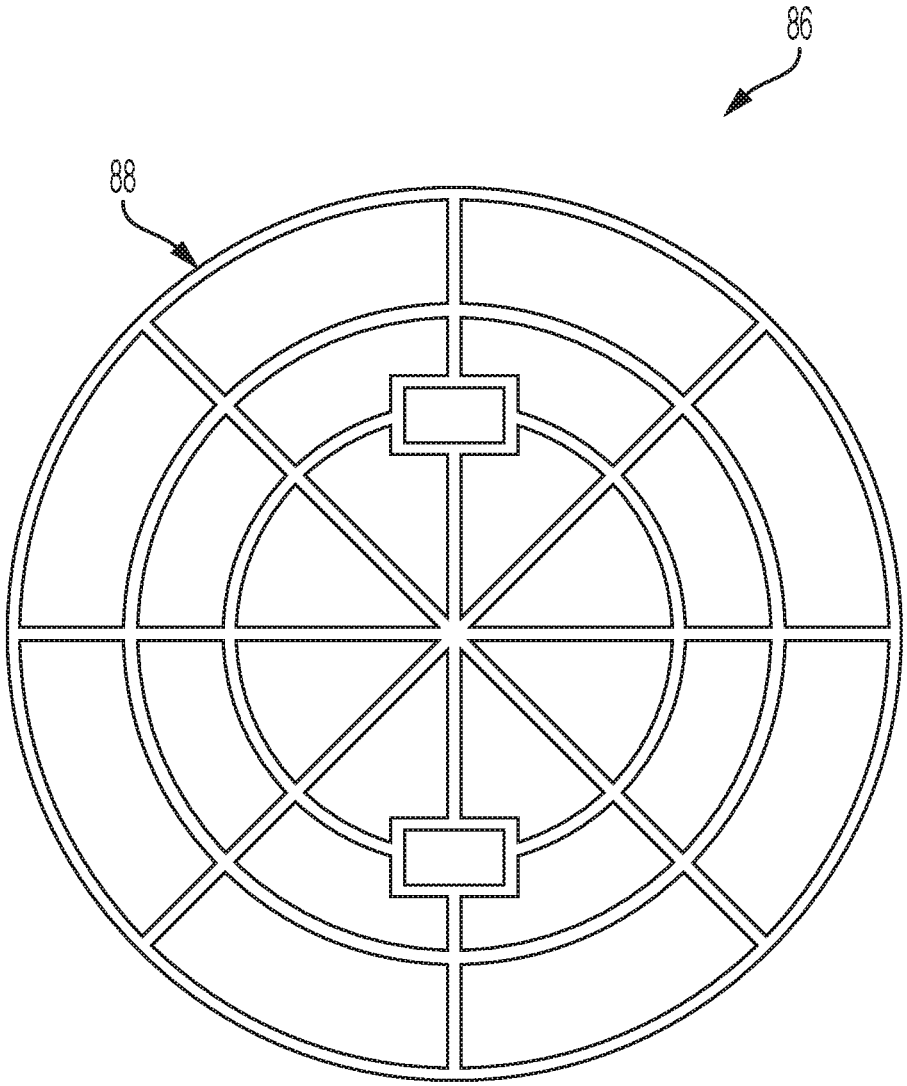
FIG. 17 is a bottom view of the upper assembly.

FIG. 3 shows an assembled, upper perspective view of the dampening device 22, while FIG. 4 is an exploded upper perspective view of the dampening device 22. According to one embodiment, the dampening device 22 is disposed about a central axis 26 and includes a base 28 attachable to the drum stand 12. The base 28 is a collar-like structure having an inner surface 30 and an outer surface 32. A plurality of recess 34 extend within the base 28 from a lower edge 40 thereof toward the upper edge 42. In the exemplary embodiment, the base 28 includes three recesses 34 which are spaced approximately 120 degrees apart from each other. Each recess 34 is sized and structured to receive a corresponding structure on the drum stand 12, such as a support arm 38, to facilitate engagement between the base 28 and the drum stand 12. Along these lines, a liner 44 may be attached to the base 28 along the edge of each recess 34, with the liner 44 being formed from rubber or similar material, for increasing friction between the dampening device 22 and the drum stand 12 to stabilize the dampening device 22 on the drum stand 12 when engaged therewith.

The upper edge 42 of the base 28 defines a ramp portion 46 extending partially around the circumference of the base 28. The ramp portion 46 includes a lower end located below an upper segment of the upper edge to define a shoulder 48 therebetween. The ramp portion 46 slopes upwardly from the lower end, away from the lower edge 40 to provide a smooth camming surface, the purpose of which will be described in more detail below.

The base 28 additionally includes a plurality of tracking grooves 50 formed along the inner surface 30 thereof, with each tracking groove 50 having a circumferential component (i.e., extends in a circumferential direction), as well as an axial component (i.e., extends in an axial direction). According to one embodiment, the tracking grooves 50 include a first sloped segment 52, a second sloped segment 54, and a third sloped segment 56, as well as a first rest segment 58, a second rest segment 60, a third rest segment 62, and a fourth rest segment 64. The first rest segment 58 is positioned at an end of the tracking groove 50 adjacent the lower edge 40 of the base 28. The first sloped segment 52 extends upwardly from the first rest segment 58 toward the second rest segment 56. The second sloped segment 54 extends upwardly from the second rest segment 56 toward the third rest segment 62. The third sloped segment 56 extends upwardly from the third rest segment 62 toward the fourth rest segment 64.

Each tracking groove 50 may be associated with a guide surface and may be sized and structured to receive a respective tracking pin 66, which is connected to a rotating plate 68. The interaction between the tracking grooves 50 and the tracking pins 66 coordinates movement of the rotating plate 68 relative to the base 28, as will be described in more detail below.

The rotating plate 68 includes a central portion 70 and a raised peripheral portion 72 circumnavigating the central portion 70. The central portion 70 may include a pair of openings 74 to accommodate a pair of magnets 76, as will be described in more detail below. The rotating plate 68 further includes a plurality of lower members 78 extending downwardly from the central portion 70 and/or the raised peripheral portion 72. Each lower member 78 is connected to a respective one of the tracking pins 66. The rotating plate 68 further includes an arm 80 extending radially outward relative to the raised peripheral portion 72.

A handle 82 may be connected to the arm 80 to facilitate user control over rotation of the rotating plate 68 relative to the base 28. The handle 82 may function as an extension of the arm 80, and may be sized and structured to allow a user to easily manipulate the arm 80 via gripping of the handle 82. The handle 82 may include a pair of openings which may be aligned with a corresponding pair of openings formed on the arm 80 to accommodate a pair of mechanical fasteners, such as a nut and bolt, wherein the mechanical fasteners are advanced through the aligned pairs of openings. The handle 80 may include a logo, or other indicia displayed thereon, with such logo or indicia being laser engraved, stamped, printed or otherwise applied to the handle. A pair of finger grips 84 may be coupled to opposed sides of the handle 80 adjacent a distal end thereof. The finger grips 84 may be formed from silicone, rubber, or other materials known in the art.

The rotating plate 68 is operatively coupled to an upper assembly 86, which generally includes a mounting plate 88, an adhesive 90, and the dampening pad 24. The mounting plate 88 includes a central portion 92 and a raised peripheral portion 94. The dampening pad 24 may have an outer circumference that is substantially identical to the outer circumference of the raised peripheral portion 94 to create a substantially flush appearance. The dampening pad 24 may also include a pair of opposed faces 96, 98 to define a dampening pad thickness therebetween. Exemplary thicknesses include 4 mm and 8 mm, although other thicknesses may be defined by the dampening pad 24 without departing from the spirit and scope of the present disclosure. The dampening pad 24 may be secured to the mounting plate 88 via the adhesive 90, which may include tape or other adhesives known in the art.

The central portion 92 of the mounting plate 88 includes a pair of openings 100 sized to receive a pair of magnets 102, wherein the magnets 102 received in the mounting plate 88 are magnetically attracted to the magnets 76 received in the rotating plate 68 to effectuate magnetic coupling therebetween. Such magnetic coupling also allows for selectively swapping of one upper assembly 86 with another upper assembly 86 to achieve a desired damping effect through variance of the dampening pad thickness. Along these lines, by swapping upper assemblies 86, a user may easily modify the dampening pad thickness to the desired thickness.

With the basic structure of the dampening device 22 being described above, the following is a description of an exemplary use of the dampening device 22. The dampening device 22 is attached to a drum stand 12 by placing the base 28 over the support arms 38 of the drum stand 12, with the support arms 38 being received in respective ones of the recesses 34 formed in the base 28. The rubber liner 44 may frictionally engage with the support arms 38 of the drum stand 12 to stabilize the base 28 relative to the drum stand 12.

The dampening device 22 may be configured for use with a particular drum 10 by adjusting the size of the dampening pad 24. Along these lines, dampening pad thickness may be varied to accommodate a particular type of drum 10, size of drum 10, or desired dampening effect. For instance, for drums 10 that are configured to rest further away from the dampening device 22, a thicker dampening pad 24 may be required, and vice versa. Furthermore, a thicker dampening pad 24 may be used to create a greater dampening force on the drum 10, while a thinner dampening pad 24 may be used to create a lesser dampening force on the drum 10. As such, modification of the dampening pad thickness may be achieved by removing one upper assembly 86 from the rotating plate 68 and placing a desired upper assembly 86 on the rotating plate 68. To remove an upper assembly 86 from the rotating plate 68, a user simply pulls the upper assembly 86 away from the rotating plate 68 with sufficient force to overcome the magnetic attraction between the magnets 102 in the upper assembly 86 and the magnets 76 in the rotating plate 68. The user then places the desired upper assembly 86 on the rotating plate 68, with the magnets 102 in the upper assembly 86 being aligned with the magnets 76 in the rotating plate 68 so as to allow for magnetic attraction therebetween to hold the upper assembly 86 in place relative to the rotating plate 68 during use of the dampening device 22.

With the drum 10 residing on the drum stand 12 above the dampening device 22, and when the user desires to impart a dampening force on the drum 100, the handle 82 is gripped by the user and is moved so as to rotate the handle 82 about the central axis 26, which causes the rotation plate 68 to rotate relative to the base and transition from a lowered position toward a raised position relative to the base 28.

More specifically, as the rotation plate 68 rotates relative to the base 28, the tracking pins 66 travel within their respective tracking grooves 50 from the lower end of the respective tracking groove 50 toward the upper end of the respective tracking groove 50, and the arm 80 rides along the ramp portion 46 of the upper edge 42. Each tracking pin 66 starts at the first rest segment 58, and then sequentially travels along the first sloped segment 52 to the second rest segment 56, then along the second sloped segment 54 to the third rest segment 62, and then along the third sloped segment 56 to the fourth rest segment 64. As the tracking pins 66 move along their tracking grooves 50 from the first rest segment 58 toward the fourth rest segment 64, the rotation plate 68 not only rotates about the central axis 26, the rotation plate 68 also moves axially along the central axis 26 to move away from the base 28 (e.g., lifting of the central portion 70 of the rotation plate 68 above the base 28). In this regard, the interaction between the tracking pins 66 and the corresponding tracking grooves 68 transfers such rotational movement of the rotation plate 68 relative to the base 28 into axial movement of the rotation plate 68 relative to the base 28. Rotation of the rotation plate 68 in a first rotational direction results in movement of the rotation plate 68 away from the base 28, as described above, while rotation of the rotation plate 68 in an opposing second rotational direction results in movement of the rotation plate 68 toward the base 28 (e.g., lowering of the central portion 70 of the rotation plate 68 toward the base 28). In this respect, the rotation plate 68 is rotatable relative to the base 28 between a first rotational position and a second rotational position, wherein the first rotational position is associated with a lowered axial position, and the second rotational position is associated with a raised axial position. According to one embodiment, the rotation plate may rotate 120 degrees or less to complete transition between the lowered axial position and the raised axial position. The second and third rest segments 56, 62 may provide intermediate stopping points for the tracking pins 66 to allow the rotation plate 68 to remain at an axial position between a lowered axial position and a raised axial position.

As the rotation plate 68 is lifted from the base 28, the dampening pad 24 may engage the drum wires 14 on the drum 10 to mitigate any unwanted vibrations thereof. To release the dampening pad 24 from the drum wires 14, the handle 82 is rotated in the opposite direction, which results in opposite relative rotational movement of the rotation plate 68 relative to the base 28. As such, assuming the tracking pins 66 are in the fourth rest segment 64, the tracking pins 66 sequentially travel from the fourth rest segment 64 along the third sloped segment 56 to the third rest segment 62, then along the second sloped segment 54 to the second rest segment 56, and then along the first sloped segment 52 to the first rest segment 58 to assume the lowered axial position.

According to one embodiment, the dampening pad 24 may be formed from ¼" thick ultra-soft, open cell, super absorbent polyurethane foam, which has the ability to reduce snare buzz when pressed against the wires 14 while applying very little pressure to the wires 14. Along these lines, it is desirable to stop the snare wires 14 from vibrating in response to ambient sounds while applying a minimal amount of pressure to the wires 14. As more pressure is applied to the wires 14, the configuration of the wires 14 may be altered which may reduce the ability of the wires 14 to vibrate, and thus, alter the natural sound of the drum 10. Therefore, by applying minimal pressure to the wire 14, the snare buzz can be mitigated, while also preserving the integrity of the wires 14. Although polyurethane foam is the preferred material, it is also contemplated that wood, fabric, rubber, other foams, felt, metal and plastic may be used to fabricate the dampening pad 24 without departing from the spirit and scope of the present disclosure.

Figure 18:
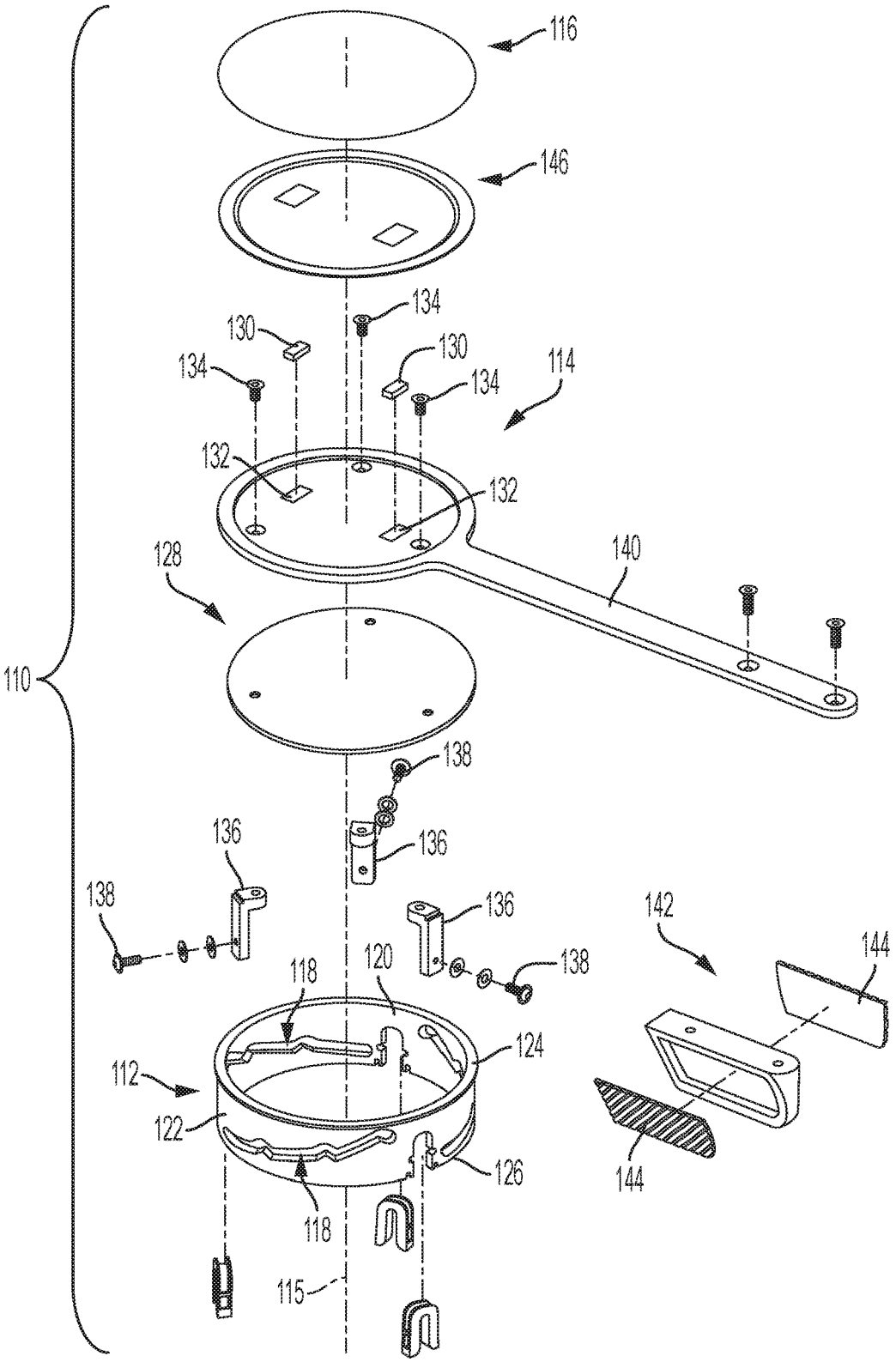
FIG. 18 is an exploded upper perspective view of another embodiment of the dampening device.

Referring now to FIG. 18, there is shown another embodiment of a dampening device 110 that is similar to the dampening device 22 described above in that it includes a base 112, a rotating plate 114 operatively coupled to the base 112 to selectively position a dampening pad 116 relative to the drum wires 14 on the drum 10. Accordingly, the following discussion will focus on the features that are unique to dampening device 110.

The base 112 is disposed about central axis 115 and defines a generally circular, ring-like configuration. The base 112 includes a plurality of tracking grooves 118 that extend completely between an inner surface 120 and an outer surface 122 of the base 112. The shape of the tracking grooves 118 may be similar to those described above, and include a plurality of sloped segments and a plurality of rest segments. The base 112 includes an upper edge 124 and a lower edge 126, wherein the distance between the upper and lower edges 124, 126 is substantially uniform around the circumference of the base 112. In other words, the base 112 may be formed without an inclined ramp section on the upper edge 124.

An intermediate plate 128 may be positioned between the rotating plate 114 and the base 112, and may provide an underlying surface which may assist in capturing magnets 130 in openings 132 formed in rotating plate 114. The intermediate plate 128 may be connected to rotating plate 114 via screws 134 or other fasteners.

The rotating plate 114 may also be connected to tabs 136, which extend in an axial direction from the rotating plate 114, and are connected to pins 138, which extend in the tracking grooves 118. Thus, as the pins 138 travel through their respective tracking grooves 118 as a result of rotating of the rotating plate 114 relative to the base 112, the axial position of the rotating plate 114 relative to base 112 may vary.

The rotating plate 114 may be integrally connected with a handle 140, which may extend radially outward therefrom. The handle 140 may be connected with a finger tab 142 having opposed finger grips 144 to aid in gripping the handle 140.

The dampening pad 116 may be coupled to the rotating plate 114, at least in part, through the use of an adhesive layer 146 positioned between the dampening pad 116 and the rotating plate 146. Magnets may also be used to couple the dampening pad 116 to the rotating plate 114, particularly to facilitate swapping of one dampening pad 116 for another having a different thickness.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A dampening device adapted for use with a drum having drum wires, the dampening device comprising:

a base having at least one tracking groove formed therein;

at least one tracking pin operatively engaged with the at least one tracking groove;

a rotating plate coupled to the at least one tracking pin and rotatable relative to the base between a first rotational position and a second rotational position; and a dampening pad coupled to the rotating plate;

interaction between the at least one tracking pin and the at least one tracking groove causing at least a portion of the rotating plate to move away from the base in response to rotation of the rotating plate from the first rotational position to the second rotational position;

interaction between the at least one tracking pin and the at least one tracking groove causing at least a portion of the rotating plate to move toward the base in response to rotation of the rotating plate from the second rotational position to the first rotational position.

2. The dampening device recited in claim 1, wherein the base is disposed about a central axis, the base including an upper edge, a lower edge, an inner surface and an outer surface, both the inner and outer surfaces extending about the central axis between the upper and lower edges, the base further including a plurality of recesses extending from the lower edge, each recess being sized to be engageable with a drum stand.

3. The dampening device recited in claim 2, wherein the plurality of recesses includes three recesses spaced 120 degrees from each other.

4. The dampening device recited in claim 1, wherein the base is disposed about a central axis, the at least one tracking groove including at least two sloped segments and a rest segment, each sloped segment including an axial component parallel to the central axis, and a radial component.

5. The dampening device recited in claim 4, wherein the at least one tracking groove includes at least three sloped segments and three rest segments.

6. The dampening device recited in claim 1, wherein the at least one tracking groove includes three tracking grooves.

7. The dampening device recited in claim 1, wherein the base is disposed about a central axis, the base including an inner surface and an outer surface, both the inner and outer surfaces extending about the central axis, the at least one tracking groove extending completely between the inner surface and the outer surface.

8. The dampening device recited in claim 1, further comprising a handle coupled to and extending from the rotating plate.

9. The dampening device recited in claim 1, wherein the base includes an upper edge and a lower edge, both of which extend around a central axis, the base defining a distance between the upper and lower edge that is substantially uniform around the circumference of the base.

10. The dampening device recited in claim 1, wherein the base includes an upper edge and a lower edge, both of which extend around a central axis, the upper edge including a ramp segment, wherein the distance between the upper edge and the lower edge varies.

11. The dampening device recited in claim 1, wherein the dampening pad is detachably coupled to the rotating plate.

12. A dampening device for mitigating vibration of drum wires on a drum, the dampening device comprising:

a base extending around a central axis and positionable adjacent the drum wires on the drum;

a rotating plate operatively coupled to base and rotatable relative to the base about the central axis between a first rotational position and a second rotational position, interaction between rotating plate and the base causing at least a portion of the rotating plate to move away from the base in response to rotation of the rotating plate from the first rotational position to the second rotational position, interaction between the rotating plate and the base causing at least a portion of the rotating plate to move toward the base in response to rotation of the rotating plate from the second rotational position to the first rotational position; and a dampening pad coupled to the rotating plate and engageable with the drum wires on the drum to mitigate vibration of the drum wires, such that when the base is positioned adjacent the drum wires, movement of the rotation body from the first rotational position toward the second rotational position moves the dampening pad toward the drum wires, and movement of the rotation body from the second rotational position toward the first rotational position moves the dampening pad away from the drum wires.

13. The dampening device recited in claim 12, wherein the base includes at least one guide surface having an axial component and a radial component relative to the central axis.

14. The dampening device recited in claim 13, wherein the at least one guide surface includes three axial components and three radial components.

15. The dampening device recited in claim 12, wherein the base includes an upper edge and a lower edge, both of which extend around a central axis, the base defining a distance between the upper and lower edge that is substantially uniform around the circumference of the base.

16. The dampening device recited in claim 12, wherein the base includes an upper edge and a lower edge, both of which extend around a central axis, the upper edge including a ramp segment, wherein the distance between the upper edge and the lower edge varies.

17. The dampening device recited in claim 12, wherein the base is disposed about a central axis, the base including an upper edge, a lower edge, an inner surface and an outer surface, both the inner and outer surfaces extending about the central axis between the upper and lower edges, the base further including a plurality of recesses extending from the lower edge, each recess being sized to be engageable with a drum stand.

18. The dampening device recited in claim 17, wherein the plurality of recesses includes three recesses spaced 120 degrees from each other.

19. The dampening device recited in claim 12, further comprising a handle coupled to and extending from the rotating plate.

20. The dampening device recited in claim 12, wherein the dampening pad is detachably coupled to the rotating plate.

* * * * *